US005505540A

United States Patent [19]

Froslund

[11] Patent Number: 5,505,540

[45] Date of Patent: Apr. 9, 1996

[54] DEVICE FOR ADMIXING A PROCESSING AGENT TO A PULP SUSPENSION

[75] Inventor: Kjell F. Froslund, Sundsbruk, Sweden

[73] Assignee: Sunds Defibrator Industries Aktiebolag, Sweden

[21] Appl. No.: 360,730

[22] PCT Filed: May 14, 1993

[86] PCT No.: PCT/SE93/00424

§ 371 Date: Dec. 27, 1995

§ 102(e) Date: Dec. 27, 1995

[87] PCT Pub. No.: WO94/00227

PCT Pub. Date: Jan. 6, 1994

[30] Foreign Application Priority Data

Jun. 30, 1992 [SE] Sweden ..... 9202011

[51] Int. Cl.[6] ..... B01F 15/02

[52] U.S. Cl. ..... 366/155.1; 366/168.1

[58] Field of Search ..... 366/155.1, 167.1, 366/168.1, 168.2, 169.1, 170.2, 170.3, 170.4, 172.2, 279

[56] References Cited

U.S. PATENT DOCUMENTS 2,833,630 5/1958 Loevenstein ..... 366/168.1
2,887,305 5/1959 Ginneken ..... 366/172.2
3,202,281 8/1965 Weston ..... 366/172.2
3,912,231 10/1975 Weber ..... 366/172.2

FOREIGN PATENT DOCUMENTS 85164 11/1991 Finland .

*Primary Examiner*—Robert W. Jenkins
*Attorney, Agent, or Firm*—Lerner, David, Littenberg, Krumholz & Mentlik

[57] ABSTRACT

Apparatus for mixing a processing medium with the pulp suspension within a bin is disclosed, the apparatus including a housing attached to a wall of the bin, a rotary shaft extending through the housing with a propeller attached to the shaft by means of a hub, and a nozzle surrounding the propeller for directing the pulp suspension from an inlet in the nozzle to the propeller. The housing includes a dilution chamber for the processing medium and an outlet from the dilution chamber for directing the processing medium towards the hub, and includes a gap separating the outlet aperture from the hub so that the processing medium can be contacted with the pulp suspension before the pulp suspension reaches the propeller.

8 Claims, 3 Drawing Sheets

DEVICE FOR ADMIXING A PROCESSING AGENT TO A PULP SUSPENSION

FIELD OF THE INVENTION

This invention relates to a device for admixing a processing agent to a pulp suspension in a bin. According to this invention the processing agent can consist of liquids and chemicals, substantially in a fluid state, for dilution or other treatment of the pulp suspension.

BACKGROUND OF THE INVENTION

During all of the various types of pulp processing, a persistently continuous and proportional admixture of processing agents to the pulp is of decisive importance in order to obtain an acceptable result.

In previously known devices the processing agent is admixed to the pulp in the lower portion of a pulp bin. The mixing device generally comprises a propeller, which accelerates the pulp to a high rate through a nozzle, whereby the surrounding pulp is continuously sucked in. The processing agent is thereby added to the pulp before it is sucked into the mixing device. In these cases, however, a high pulp concentration in the bin, for example 12%, creates a problem for achieving continuous admixing. In order to reduce this problem, bins have been designed in order to have a bottom zone of reduced size. This, however, results in a decrease in processing volume, as well as a more complicated and more expensive bin design. Such an arrangement also requires more energy, since it is an incomplete admixing technique.

According to the present invention, the above problem is eliminated in view of the fact that the processing agent is added and distributed centrally, and the pulp flow is improved. The mixing result is improved, while at the same time the energy consumption is minimized.

SUMMARY OF THE INVENTION

In accordance with the present invention, these and other objects have now been realized by the discovery of apparatus for mixing a processing medium with a pulp suspension within a bin in which the apparatus includes a housing for attachment to a wall of the bin, a rotary shaft extending through the housing into the interior of the bin, a propeller attached to the rotary shaft, the propeller including a hub for attachment to the rotary shaft, and nozzle means surrounding the propeller and including an inlet for directing the pulp suspension from the inlet to the propeller, the housing including a dilution chamber for the processing medium and an outlet aperture for the dilution chamber for directing the processing medium towards the hub, the outlet aperture and the hub being separated by a predetermined gap whereby the processing medium is contacted with the pulp suspension before the pulp suspension contacts the propeller.

In a preferred embodiment the housing is a conical configuration.

In accordance with another embodiment of the apparatus of the present invention, the outlet aperture from the dilution chamber extends about the entire circumference of the rotary shaft. In another embodiment, the apparatus includes sealing means for sealing the shaft through the wall of the bin. Preferably in this embodiment the sealing means is directly connected to the dilution chamber whereby the sealing means is not in direct contact with the pulp suspension.

In accordance with another embodiment of the apparatus of the present invention, the nozzle includes a plurality of guide bars mounting the nozzle around the propeller with respect to the wall of the bin. In another embodiment the predetermined gap is adjustably alterable by axial movement of the rotary shaft. In yet another embodiment, the apparatus includes aperture means extending through the hub for permitting at least a portion of the processing medium to pass through the aperture means for subsequent contact with the pulp suspension downstream of the hub.

BRIEF DESCRIPTION OF THE DRAWINGS

The following detailed description can be more readily appreciated with reference to the Figures, in which.

DETAILED DESCRIPTION

Figure 1:
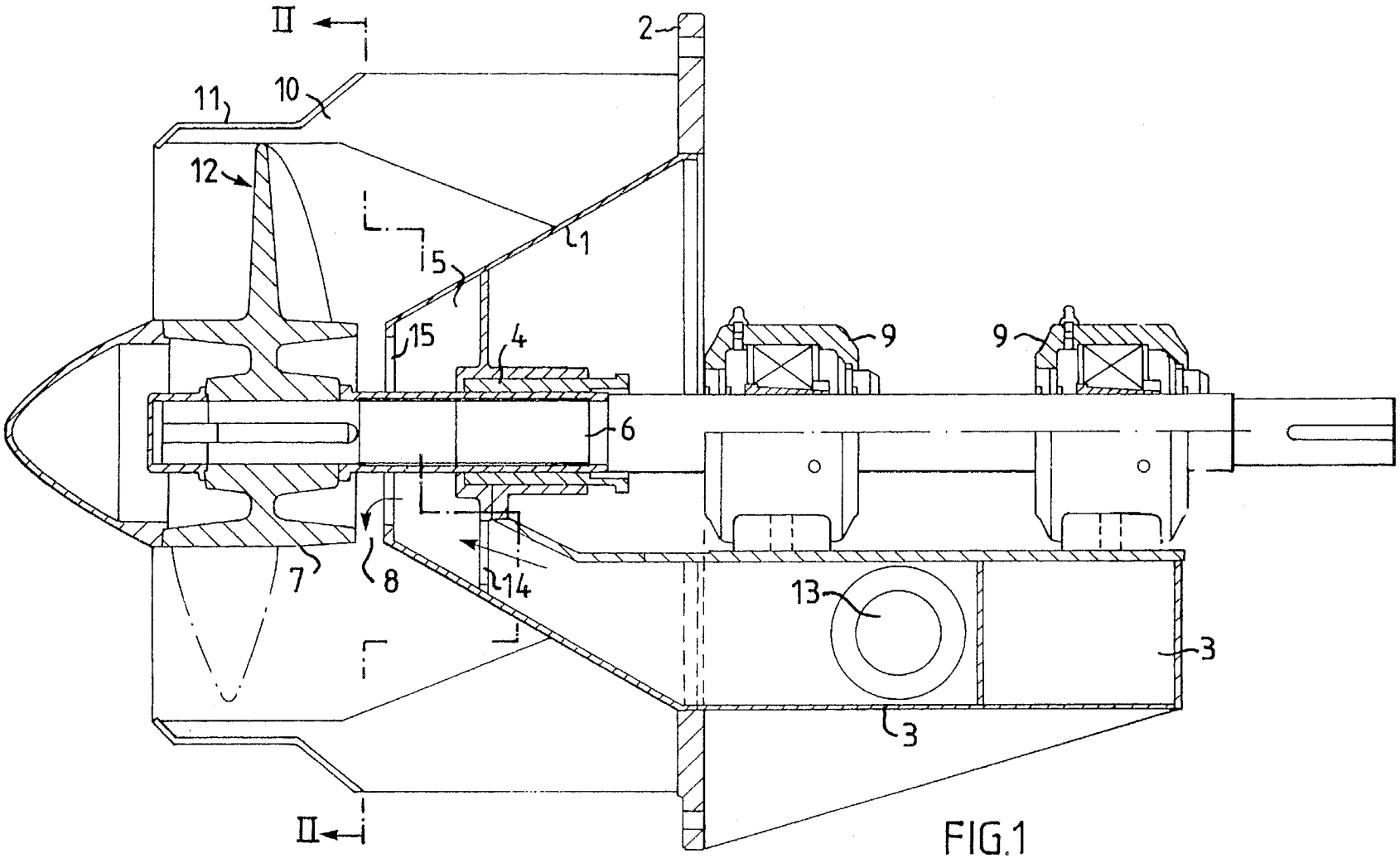
FIG. 1 is a side, elevational, partially cross-sectional view of a mixing device in accordance with the present invention.
Figure 2:
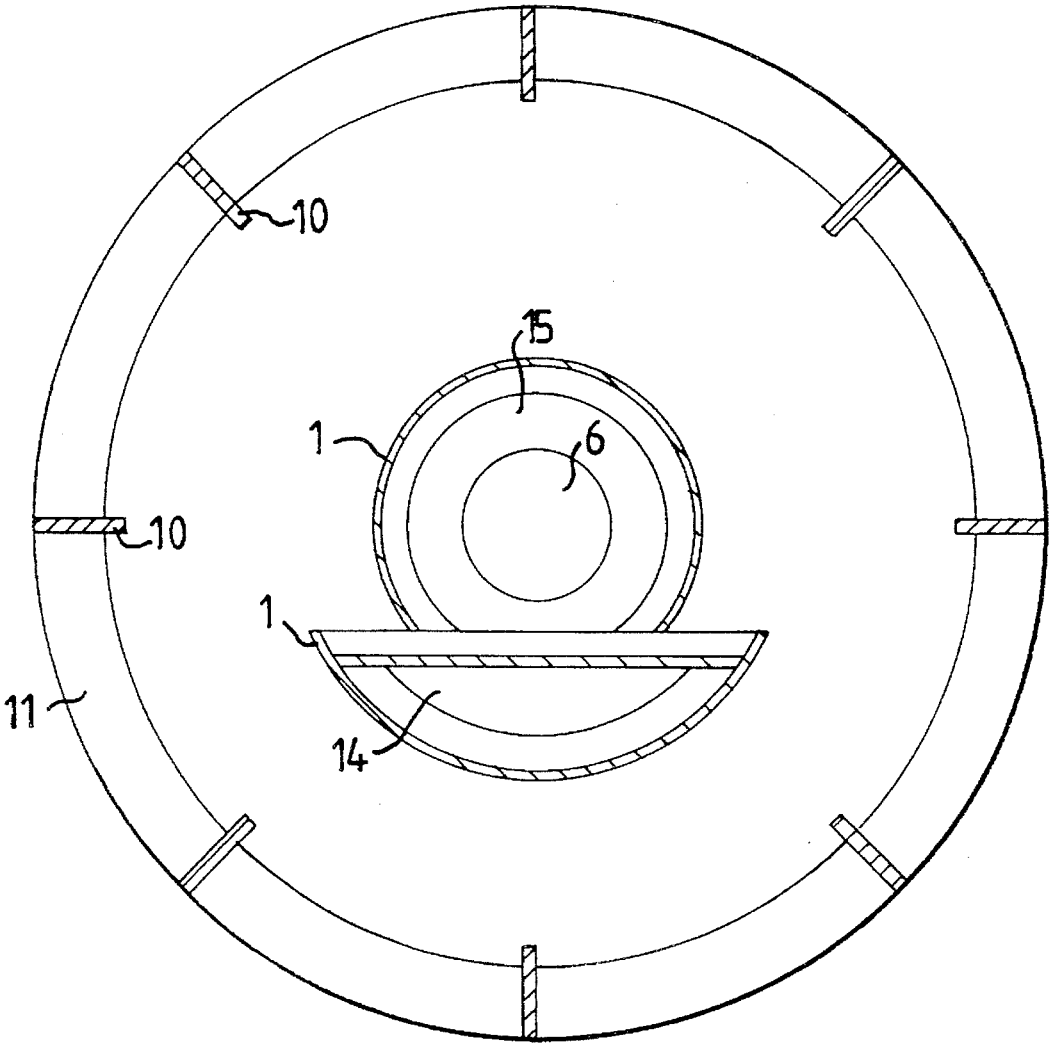
FIG. 2 is a front, elevational, cross-sectional view of the mixing device shown in FIG. 1 taken along lines II—II thereof.

The mixing device in FIG. 1 comprises a conical housing 1 with a flange 2 to be attached in the lower portion of a bin for the pulp suspension which the processing agent is to be admixed. The housing 1 comprises a supply chamber 3 with a connection 13, through which the processing agent is introduced. In the housing 1, a rotary shaft 6 is located, and the rotary shaft is supported in bearings 9, by means of a seal 4 extending into the bin. The shaft 6 is driven by a motor (not shown) located outside the bin. At the other end of the shaft 6 a propeller 12 is attached. The propeller 12 is itself formed with a hub 7. The internal portion of the housing 1 located nearest to the propeller hub 7 consists of an overall dilution chamber 5, which communicates with the supply chamber 3 through a passage 14. The dilution chamber 5 has an annular aperture 15 with respect to the hub 7. Between the housing 1 and the hub 7 a gap 8 is defined which is adjustable by moving the shaft 6 axially. The gap embodies preferably 360° of the circumference.

The seal 4, which is essentially a mechanical seal, is located in direct connection to the dilution chamber 5 and, therefore, does not come into contact with the pulp suspension. In this manner clogging is prevented.

On the conical housing 1 with flange 2 a number of guide bars 10 are attached. The guide bars 10 are substantially radial and constitute a hold for the nozzle 11, which is located about the propeller 12 and comprises converging inlet and outlet portions, respectively, and a substantially cylindrical central portion. The guide bars 10, preferably at least eight in number, extend along the entire length of the nozzle 11 in a manner such that the outer diameter of the guide bars 10 coincides with the inlet diameter of the nozzle 11. In the cylindrical portion of the nozzle 11, the inner diameter of the guide bars 10 is constant. The distance between the blades of the propeller 12 and the guide bars is about 10–15 mm.

The processing agent is introduced by way of the chamber 3 to the dilution chamber 5, from which the agent is distributed all about the adjustable gap 8. Upon its egress from the gap 8, the agent is admixed with the pulp suspension when the suspension, by action of the propeller 12, passes the mixing zone outside the gap 8 at a high rate. The flow of the pulp suspension at that point is substantially greater than that of the processing agent. The admixing takes place by means of the blades of the propeller 12 against the guide bars 10.

The guide bars 10 prevent concurrent rotation of the pulp in the inlet to the nozzle 11. The pulp flow is therefore substantially laminar all the way to the gap 8. Due to the rotation, the pulp jet leaving the nozzle 11 at a high rate has a greater cast length, while at the same time the through flow increases. This results in a very efficient admixture.

Figure 3:
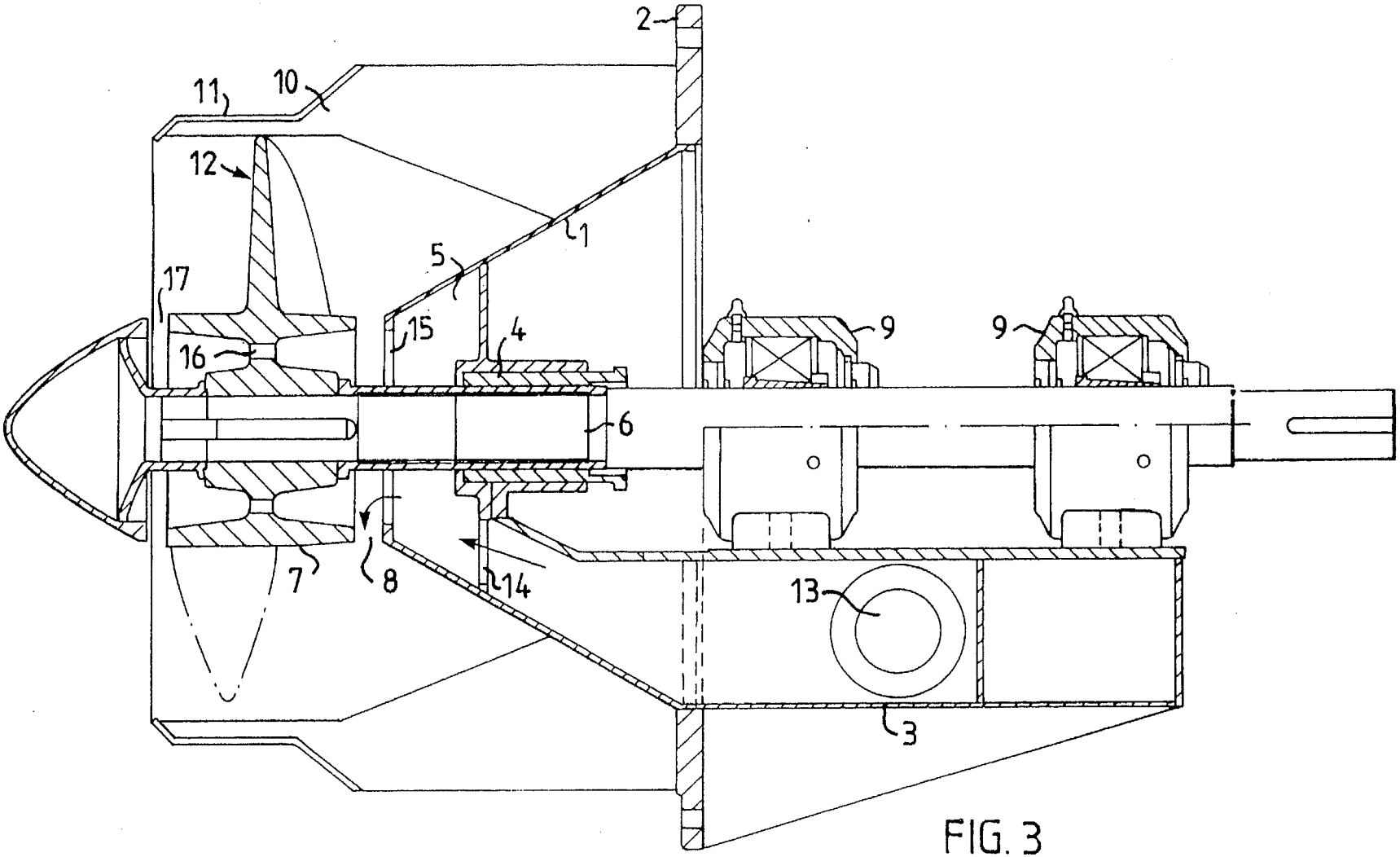
FIG. 3 is a side, elevational, partially cross-sectional view of another embodiment of the mixing device according to the present invention.

In the embodiment according to FIG. 3, a number of holes 16, e.g., from about 4 to 8, are made through the hub 7. Further, a second gap 17 is arranged in the hub in front of the blades of the propeller 12. In this embodiment a part of the flow of the processing agent passes through the holes 16 in the hub 7 and out through the gap 17 for admixing to the pulp suspension after or downstream of the blades of the propeller 12, as seen in the direction of flow. Such an embodiment can be advantageous in some installations. Also, instead of the second gap in the hub there can be arranged a number of holes.

The admixture preferably is carried out at a pulp concentration of from about 1 to 8% in the mixing zone. The energy input for the mixing work can be limited to about 0.5 to 1.5 $kW/m^3$ pulp, the rate in the mixing zone can be from about 1 to 3 m/sec.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. Apparatus for mixing a processing medium with a pulp suspension within a bin, said apparatus comprising a housing for attachment to a wall of said bin, a rotary shaft extending through said housing into the interior of said bin, a propeller attached to said rotary shaft, said propeller including a hub for attachment to said rotary shaft, and nozzle means surrounding said propeller and including an inlet for said pulp suspension whereby said pulp suspension can flow from said inlet to said propeller, said housing including a dilution chamber for said processing medium and an outlet aperture from said dilution chamber for directing said processing medium towards said hub, said outlet aperture and said hub being separated by a predetermined gap whereby said processing medium is contacted with said pulp suspension before said pulp suspension contacts said propeller.

2. The apparatus of claim 1 wherein said housing has a conical configuration.

3. The apparatus of claim 1 wherein said outlet aperture from said dilution chamber extends about the entire circumference of said rotary shaft.

4. The apparatus of claim 1 including sealing means for sealing said shaft through said wall of said bin.

5. The apparatus of claim 4 wherein said sealing means is directly connected to said dilution chamber whereby said sealing means is not in direct contact with said pulp suspension.

6. The apparatus of claim 5 wherein said nozzle includes a plurality of guide bars mounting said nozzle around said propeller with respect to said wall of said bin.

7. The apparatus of claim 1, wherein said predetermined gap is adjustably alterable by axial movement of said rotary shaft.

8. The apparatus of claim 1 including aperture means extending through said hub for permitting at least a portion of said processing medium to pass through said aperture means for subsequent contact with said pulp suspension downstream of said hub.

* * * * *

UNITED STATES PATENT AND TRADEMARK OFFICE

CERTIFICATE OF CORRECTION

PATENT NO. : 5,505,540

DATED : April 9, 1996

INVENTOR(S) : Kjell F. Froslund

It is certified that error appears in the above-identified patent and that said Letters Patent is hereby corrected as shown below:

On the title page, item

[86] Line 2, "§ 371 Date", delete "Dec. 27, 1995" and insert therefor --Dec. 27, 1994--

Line 3, "§ 102(e) Date", delete "Dec. 27, 1995" and insert therefor --Dec. 27, 1994--.

Signed and Sealed this

Twenty-third Day of July, 1996

*Attest:*

Bruce Lehman

BRUCE LEHMAN

*Attesting Officer*

*Commissioner of Patents and Trademarks*